US006342149B1

(12) United States Patent
Köster et al.

(10) Patent No.: US 6,342,149 B1
(45) Date of Patent: Jan. 29, 2002

(54) METHOD FOR CARBOXYLATING TERMINAL ALKYNES

(75) Inventors: Frank Köster, Pforzheim; Eckhard Dinjus, Leimersheim, both of (DE)

(73) Assignee: Forschungszentrum Karlsruhe, Karlsruhe (DE)

( * ) Notice: Subject to any disclaimer, the term of this patent is extended or adjusted under 35 U.S.C. 154(b) by 0 days.

(21) Appl. No.: 09/623,418

(22) PCT Filed: Mar. 3, 1999

(86) PCT No.: PCT/EP99/01366

§ 371 Date: Sep. 5, 2000

§ 102(e) Date: Sep. 5, 2000

(87) PCT Pub. No.: WO99/45173

PCT Pub. Date: Sep. 10, 1999

(30) Foreign Application Priority Data

Mar. 5, 1998 (DE) ..... 198 09 532

(51) Int. Cl.[7] ..... C25B 3/00

(52) U.S. Cl. ..... 205/440; 205/441; 205/455

(58) Field of Search ..... 205/440, 441, 205/455

(56) References Cited

PUBLICATIONS (1) Elisabet Dunach et al., "Electrochemical Carboxylation of Terminal Alkynes Catalyzed by Nickel Complexes: Unusual Regioselectivity", J. Organomet. Chem., vol. 352, No. 1–2, 1988, pp. 239–246, XP002108474, no month available.

(2) Sylvie Derien et al., "Activation of Carbon Dioxide: Nickel–Catalyzed Electrochemical Carboxylation of Diynes", J. Org. Chem., vol. 58, No. 9, 1993, pp. 2578–2588, XP002108475, no month available.

*Primary Examiner*—Edna Wong
(74) *Attorney, Agent, or Firm*—Venable; Robert Kinberg

(57) ABSTRACT

A method for carboxylating terminal alkynes that have at least one additional aliphatic carbon atom in an α position and that do not have a proton which has a higher acidity than that of the proton of the terminal triple bond. In an undivided electrolysis cell equipped with a cathode and an anode, a solution of the terminal alkyne in an aprotic solvent is acted upon by carbon dioxide at a pressure higher than atmospheric pressure. The invention provides a method in which carbon dioxide is selectively inserted between the terminal C—H bond, without disturbing the triple bond, and can be carried out without a catalyst or catalyst precursor.

5 Claims, 2 Drawing Sheets

METHOD FOR CARBOXYLATING TERMINAL ALKYNES

The invention relates to a method for carboxylating terminal alkynes, as defined in the preamble to the first claim.

A method of this type is known from the publication by S. Dérien, J.-C. Clinet, E. Dunach and J. Périchon: "Activation of Carbon Dioxide: Nickel-Catalyzed Electrochemical Carboxylation of Diynes," J. Org. Chem. 1993, 58, 2578–2588. In this method, a dialkyne that has been dissolved in dimethyl formamide is placed in a pressure-tight electrolysis cell without a membrane, and carboxylated with gaseous carbon dioxide under a pressure of 1 to 5 bar. For the carboxylation process, a catalyst comprising an LNi (0) complex is used, with L representing an organic chemical ligand. The catalyst is created on the spot from the corresponding ligand and Ni (II) salts through electrolysis. A carbon fiber as a cathode, and a magnesium anode, serve as electrodes of the electrolysis cell.

This carboxylation yields a series of different carboxylic acids. On the one hand, aromatic or cycloaliphatic carboxylic acids are formed through cyclization. In addition to carboxylic acids with terminal carboxyl groups, carboxylic acids having secondary carboxyl groups are formed. A feature common to all of the reaction products, however, is that this terminal triple bond of the alkyne involved in the carboxylation is converted into a double bond. Therefore, this method cannot be used to produce 2-alkyne carboxylic acids from the terminal alkynes.

In "Ligand-directed reaction products in the nickel-catalyzed electrochemical carboxylation of terminal alkynes," Journal of Organometallic Chemistry, 353 (1988), C51–C56, E. Labbé, E. Dunach and J. Périchon describe the influence of N and P ligands for use in nickel catalysts for electrochemical carboxylation. With one of the nickel catalysts (Ni(cyclam)$Br_2$), 1-octyne reacted to 2-nonyne carboxylic acid with a high selectivity.

E. Dunach and J. Périchon report on further attempts at the electrochemical carboxylation of terminal alkynes with the aid of nickel complex catalysts in "Electrochemical carboxylation of terminal alkynes catalyzed by nickel complexes: unusual regioselectivity," Journal of Organometallic Chemistry, 352 (1988), 239–245. In this carboxylation process, the triple bond is converted to a double bond, so no alkyne carboxylic acids can be formed.

SUMMARY OF THE INVENTION

It is the object of the invention to propose a method of the type mentioned at the outset, in which carbon dioxide is selectively inserted between the terminal C—H bond, with the triple bond being retained. A nickel complex catalyst is to be omitted here.

The object is accomplished by the features of the first claim. The further claims disclose preferred embodiments of the method.

According to the invention, terminal alkynes are carboxylated with gaseous carbon dioxide in an aprotic solvent; the carboxylation is performed in an undivided electrolysis cell without the use of a catalyst or catalyst precursor. Suitable terminal alkynes are, notably, the alkynes having 2 to 9 carbon atoms. Substituents of the terminal alkyne, but also ether functions and additional double or triple bonds, typically do not interfere with the reaction, because the terminal, triple-bonded carbon atom is selectively monocarboxylated with the method of the invention. Terminal alkynes having a further acidic proton, particularly those having a hydroxyl group, enter into secondary reactions, however; they are therefore unsuitable as starting materials. Alkynes having a non-terminal triple bond are not carboxylated according to the invention.

The gaseous carbon dioxide is supplied to the electrolysis under an overpressure, preferably at a pressure of 0.2 to 5 bar. Pressures of 0.5 to 1 bar are especially preferred. Pressures above 1 bar, but especially above 5 bar, effect a reduced yield, and should therefore be avoided. The reaction temperature can be room temperature. Higher or lower temperatures are not significantly advantageous.

According to the invention, the carboxylation is performed in an aprotic solvent. Dimethyl formamide is a particularly suitable solvent; acetonitrile and tetrahydrofuran can also be used, however.

The method of the invention is performed in an undivided electrolysis cell having a cathode and an anode, the cell being sufficiently pressure-tight and having a gas supply line for the carbon dioxide. In principle, metals are suitable as a cathode, but not the carbon fibers used in the prior art. Silver cathodes attain especially high reaction yields. Metals that can oxidize easily, such as zinc and aluminum, are suitable as anode material; magnesium is preferred.

The electrolysis is preferably performed under galvanostatic conditions. Typically, maximum voltages of 20 V and current intensities in a range of 50 mA are established.

The invention is described in detail below in conjunction with figures and embodiments.

BRIEF DESCRIPTION OF THE DRAWINGS

Shown are in:

FIG. 1 schematically illustrates an apparatus for executing the method of the invention. A terminal alkyne and an aprotic solvent are placed in an electrolysis cell 2. With the aid of a carbon dioxide gas tank 1, the electrolysis cell 2, whose contents can be mixed thoroughly with a magnetic stirrer 3, is acted upon by a carbon-dioxide overpressure. The electrodes in the electrolysis cell are connected to a current source 4. The electrolysis occurs under galvanostatic conditions.

FIG. 2 illustrates an embodiment of the electrolysis cell. The electrolysis cell forms an autoclave, which can be acted upon by the carbon-dioxide pressure by way of the gas supply line 10. The anode 11 and the cathode 12 are connected to a current source (not shown). A magnetic stirring rod 13 for thoroughly mixing the reaction solution is disposed in the reaction chamber of the electrolysis cell.

Figure 1:
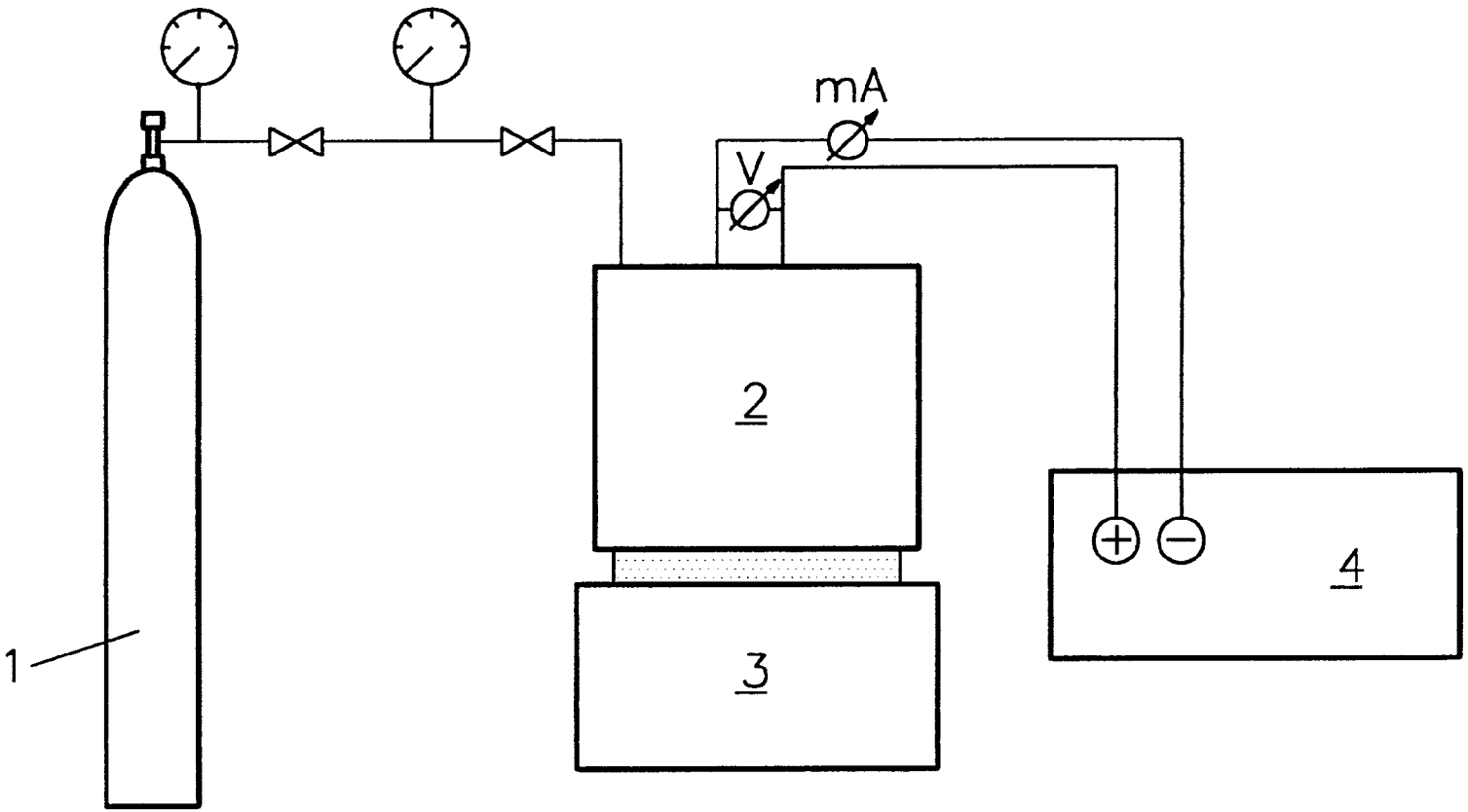
FIG. 1 a schematic representation of an apparatus for executing the method.
Figure 2:
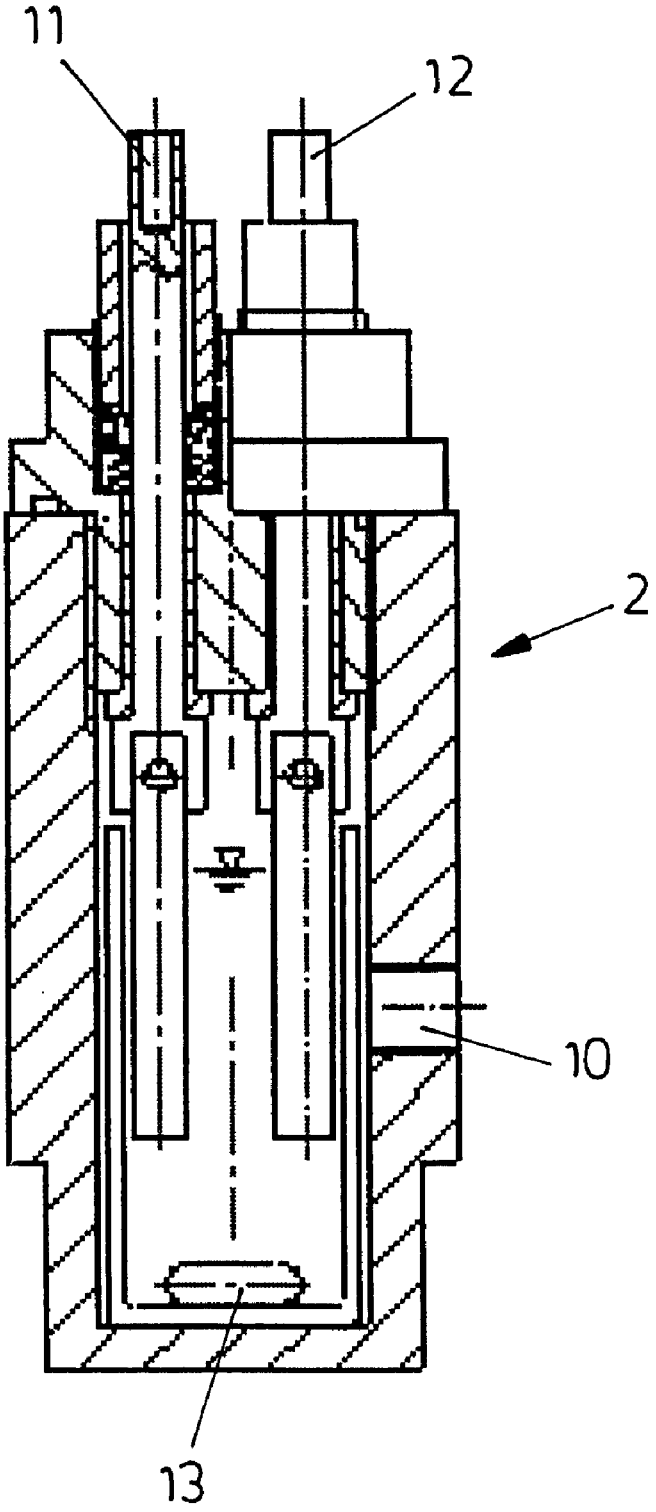
FIG. 2 an embodiment of the electrolysis cell.

A series of carboxylations was performed with the apparatus shown in FIGS. 1 and 2 according to the following guidelines.

Prior to filling, the electrolysis cell was rinsed with carbon dioxide in order to remove atmospheric oxygen from the cell. The dimethyl formamide (DMF) used as the solvent was dried over calcium hydroxide, freshly distilled off and used immediately. Three mmol of the terminal alkyne were dissolved in DMF and placed in the electrolysis cell. With constant stirring, carbon dioxide was pressed on with a pressure of 0.5 bar. The electrochemical reaction was not started until after 15 minutes to ensure that the solution equilibrium of carbon dioxide had been established in the DMF. The experiments were conducted under galvanostatic conditions, with current intensities of 50 mA and maximum voltages of 20 V being established. The experiments were conducted with a silver cathode.

After the reaction ended, the solution was removed from the electrolysis cell and further processed directly in a single-neck flask. Four mmol of potassium carbonate and a surplus of methyl iodide were added to the electrolyte. The formed acids were esterified at 50° C. over 12 hours. The solution was then hydrolyzed with 1 m of hydrochloric acid solution, and the formed esters were extracted with diethyl ether, which separated all of the water-soluble components from the organic components. The diethyl ether phase was washed with water and dried over magnesium sulfate. The products were processed by column chromatography. Silica gel was used as the column material, and mixtures of dichloromethane and hexane were used as the solvent. The products were then analyzed.

The following terminal monoalkynes were carboxylated according to these guidelines:

1-octyne 1-nonyne cyclohexal acetylene acetylene.

In all cases, the triple bond was retained, and the $CO_2$ was inserted into the terminal C—H bond. The yields were between 80 and 90%. The following reaction equation resulted:

1) $e^-$ $$R—C{\equiv}C—H+CO_2 \text{ - - - } \rightarrow R—C{\equiv}C—COOCH_3$$

2) MeI

To examine the influence of further functional groups, such as further triple bonds, double bonds or heteroatoms, on the reaction, corresponding experiments were conducted with functionalized alkynes and $CO_2$:

1,7-octadiyne 1,8-nonadiyne propargyl ether 2-methyl,3-butyne-1-ene butyne pentether methoxy,3-butyne.

These compounds were also carboxylated with a high selectivity through the insertion of $CO_2$ into the terminal C—H bond, with the yields likewise being between 80 and 90%. With the dialkynes, only a single terminal C—H bond was carboxylated. No rearrangement or addition reaction was observed at the double and triple bonds, so in all cases, the corresponding 2-alkyne monocarboxylic acid was obtained.

Experiments with diphenyl acetylene and phenyl acetylene, however, yielded a wide spectrum of products. With phenyl acetylene, most notably, the corresponding dicarboxylation and monocarboxylation products were created. With one or two phenyl groups directly adjacent to the triple bond, a selective carboxylation of the triple bond is accordingly impossible to perform.

Likewise, no carboxylation occurred when protons having a greater acidity than the proton of the terminal triple bond were present at the terminal alkyne. Thus, terminal alkynes having a hydroxyl group, such as 3-butynol, cannot be carboxylated according to the invention.

In further experiments, the influence of the cathode material on the yield of the carboxylation was determined. The experiments were conducted with $C_7H_{15}$—C≡C—H according to the above guidelines, with the cathode material being varied.

In the use of a silver cathode, the corresponding carboxylic acid methyl ester $C_7H_{15}$—C≡C—$COOCH_3$ formed with a yield of 90%; a component of 5% of the terminal alkyne was not converted. With a nickel cathode, the corresponding carboxylic acid methyl ester (Product I) was formed with a yield of 55%; a component of 35% of the terminal alkyne did not react. In addition, a secondary reaction produced a 35% yield of the alkenoic acid methyl ester $C_7H_{15}$—CH≡CH—$COOCH_3$ (Product II), in which the triple bond was reduced to a double bond. A platinum cathode produced Product I with a 5% yield, and Product II with a 40% yield. 35% of the terminal alkyne was not converted. In contrast, a cathode comprising a carbon fiber almost exclusively yielded Product II, while 75% of the terminal alkyne was not converted.

What is claimed is:

1. A method for carboxylating terminal alkynes, said method comprising the steps of a) forming a solution from a terminal alkyne and an aprotic solvent, wherein said terminal alkyne i) has at least one further aliphatic carbon atom in a position, and ii) has no proton that possesses a higher acidity than the proton of the terminal triple bond; and b) contacting said solution with carbon dioxide under a pressure higher than atmospheric pressure in an electrolysis cell wherein a cathode and an anode are connected to a voltage source, wherein the carboxylation is performed without a catalyst or a catalyst precursor.

2. The method according to claim 1, wherein said terminal alkyne has between 2 and 9 carbon atoms.

3. The method according to claim 1, wherein the pressure is 0.5 to 1 bar.

4. The method according to claim 1, wherein said cathode is silver.

5. The method according to claim 1, wherein the electrolysis cell is operated under galvanostatic conditions.

* * * * *